US006655474B1

(12) United States Patent
Accorroni

(10) Patent No.: US 6,655,474 B1
(45) Date of Patent: Dec. 2, 2003

(54) DRILL FOR MAKING WIDE DIAMETER AND HIGH DEPTH HOLES AND METHOD FOR CARRYING OUT SAID HOLES

(75) Inventor: Giulio Accorroni, Osimo (IT)

(73) Assignee: I.M.T. S.p.A., Osimo (IT)

( * ) Notice: Subject to any disclaimer, the term of this patent is extended or adjusted under 35 U.S.C. 154(b) by 0 days.

(21) Appl. No.: 09/936,243

(22) PCT Filed: Mar. 11, 2000

(86) PCT No.: PCT/IB00/00261

§ 371 (c)(1),
(2), (4) Date: Sep. 7, 2001

(87) PCT Pub. No.: WO00/53882

PCT Pub. Date: Sep. 14, 2000

(30) Foreign Application Priority Data

Mar. 11, 1999 (IT) ..... PS99A0007

(51) Int. Cl.[7] ..... E21B 49/00

(52) U.S. Cl. ..... 175/58; 175/161; 175/207; 175/284

(58) Field of Search ..... 175/57, 58, 161, 175/207, 203, 88, 266, 284, 265, 308, 309

(56) References Cited

U.S. PATENT DOCUMENTS

| | | | | | |
|---|---|---|---|---|---|
| 1,803,228 | A | | 4/1931 | Beaver | |
| 2,719,698 | A | | 10/1955 | Darin et al. | |
| 2,910,274 | A | | 10/1959 | Scott | |
| 3,194,329 | A | * | 7/1965 | Wallers | 175/316 |
| 3,596,722 | A | * | 8/1971 | Allard | 175/93 |
| 3,621,923 | A | * | 11/1971 | Allard | 175/24 |
| 3,757,876 | A | * | 9/1973 | Pereau | 175/267 |
| 3,835,941 | A | * | 9/1974 | King | 175/88 |
| 3,987,856 | A | * | 10/1976 | Carl et al. | 173/149 |
| 4,223,870 | A | | 9/1980 | Bartholomew | |
| 4,265,036 | A | * | 5/1981 | Staats | 37/340 |
| 4,295,534 | A | * | 10/1981 | Zachmeier | 175/88 |
| 4,429,754 | A | * | 2/1984 | Cormier | 175/88 |
| 4,526,242 | A | * | 7/1985 | Mathieu et al. | 175/94 |
| 4,604,818 | A | * | 8/1986 | Inoue | 37/195 |
| 4,616,720 | A | | 10/1986 | Kitanaka | |
| 4,627,180 | A | * | 12/1986 | Learnahan | 37/184 |
| 4,971,163 | A | | 11/1990 | Ohashi et al. | |
| 5,518,076 | A | * | 5/1996 | Holz et al. | 175/57 |

FOREIGN PATENT DOCUMENTS

| | | | | |
|---|---|---|---|---|
| DE | 2530531 | | 1/1977 | |
| DE | 3440727 | A1 * | 5/1986 | E21B/11/02 |
| EP | 0050954 | | 5/1982 | |
| EP | 0628700 | A2 * | 12/1994 | E21B/27/00 |
| JP | 06229183 | A * | 8/1994 | E21B/3/04 |

* cited by examiner

*Primary Examiner*—William Neuder
*Assistant Examiner*—Jennifer H Gay
(74) *Attorney, Agent, or Firm*—William J. Sapone; Coleman Sudol Sapone, P.C.

(57) ABSTRACT

A drill for drilling wide diameter and high depth holes in the soil including a base machine (1) having a rotary (2) that is equipped with a clamp (9) and, by means of translation cylinders (8), rotates and axially moves a series of drill stem (7) having a tool (6) at the free end thereof, includes:

an hydraulic joint (3) linked to the rotary (2);

at least a winch (4) linked to the hydraulic joint (3) and provided with at least a wire rope (18);

a carrier canister (5) slidely connected with the stem (7) between the rotary (2) and the tool (6) by means of at least the wire rope (18);

at least a winch (4), a wire rope (18), a carrier canister (5) are rotated together with the stem (7) of the rotary (2) in correspondence of an operating condition of the drill.

12 Claims, 5 Drawing Sheets

FIG. 2
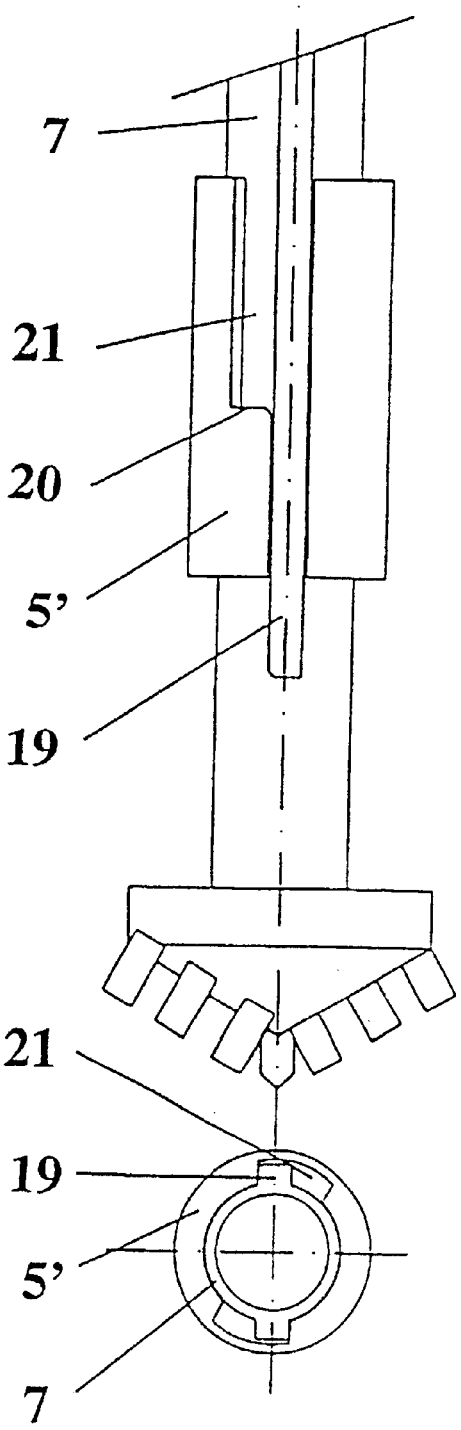
FIG. 3
FIG. 4
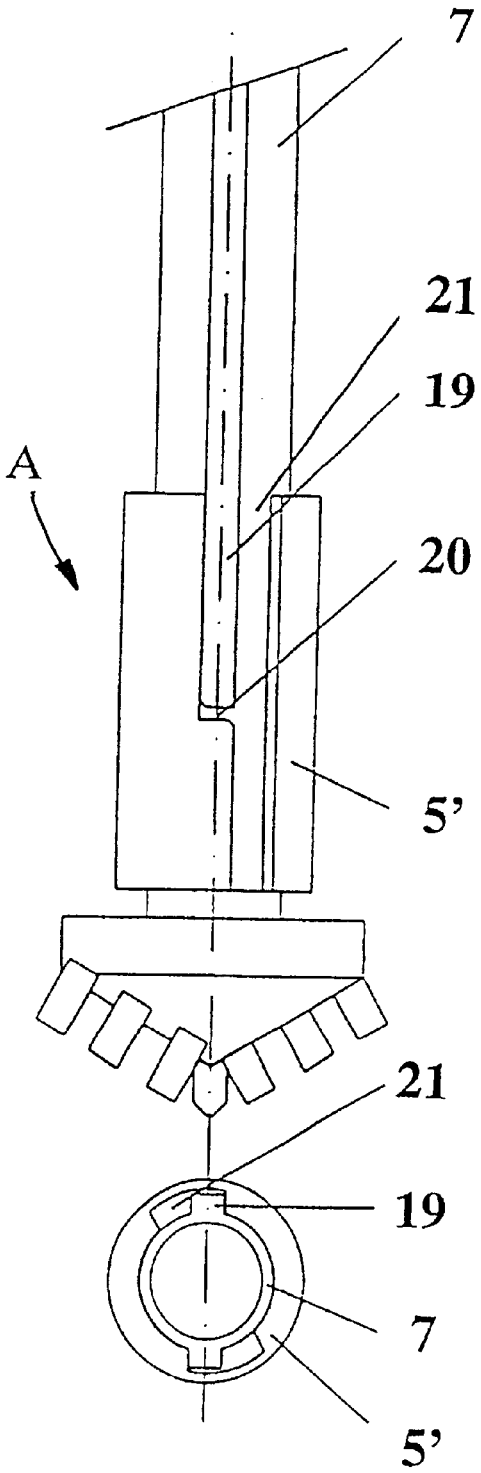
FIG. 5

DRILL FOR MAKING WIDE DIAMETER AND HIGH DEPTH HOLES AND METHOD FOR CARRYING OUT SAID HOLES

TECHNICAL FIELD

The invention relates to a drill fit for carrying out wide diameter and high depth holes, especially for pilings and wells, and method for carrying out thereof.

BACKGROUND ART

Document U.S. Pat. No. 2,910,274 discloses a drill for digging holes for pouring bell-shaped footings having a motor rigidly fixed to the lower and of an upper column member. The motor is connected by means of pinions to a lower column member and axially rotates the lower column member with respect to the upper column member.

The drill includes an hydraulic fed linked to the motor. The whole column assembly, including column members and motor, is shifted vertically by means of a cable wound up on a reel of a crane and fixed to an arm of a boom engaging pulleys associated to the rigid connection between motor and upper column member.

A carrier canister is fixed to the lower and of the lower column member and has, at list at its free and, a digging tool. A support assembly of the canister reciprocates along lower column member, by means of an hydraulic actuator, to open and close the carrier canister.

The main drawbacks of this known drill consist in that, because of the column members, it cannot carry out high depth holes and, because or the fixed connection between the canister and the lower and of the lower column member, the digging phase must be stopped in correspondence of the descending, unloading and lifting of the canister.

The piles for the soil consolidation are commonly realized during the drilling phase, the reinforcement bar installation and concrete casting. The drillings are carried out by means of soil cutting or crumbling and carrying away the removed material.

Currently the material removing is done by means of either intermittent transport, using hammer grabs or a telescopic Kelly driven by a rotary, that must be lifted each time, or continuous transport by means of a cochlea or by fluid circulation.

The hammer grab utilization is limited to the scarce cohesion grounds, particularly to transport material trough the casing pipes.

Using the rotary with telescopic Kelly system is possible to make holes for wide diameter piles (up to 2–3 meters) but for limited depth, typically 50–60 m. The depth limit is due to the fact that the cutting and material transport tool is linked to the inferior end of series of telescopic stem fit to transmit the cutting torque. With the hole depth increasing, the stem length or the number of the used elements must increase with difficulties imposing the cited limits.

Increasing the diameter, the resistance of said elements must be also increased. So the wide diameter and high depth holes can be obtained only with very high, heavy and expensive machines that sometimes don't have the required space to operate.

With the cochlea system, it is used an helix with the sharp tools in the inferior part, linked in the upper part to a rotary that drive the rotating movement and to extraction wire ropes. Said method requires high extraction forces and very high machines, whose height is comparable to the hole depth. Practically holes with 1,2–1,5 m as maximum diameter and 25–30 m as maximum depth are possible.

The circulating fluid systems require water pumps, or air compressors with flows growing with the diameter and depth increasing. Said systems allow to reach very high depth only if the working diameters are small (200–300 mm). Wider diameter holes (800–1400 mm) would be done using great flow rates required to the crumbled material lifting.

The reverse circulation system allows to drill deep and large diameter holes lifting the cut or crumbled material in a stream of water moved upward inside the stem by compressed air. This system can be used only in waterproof soil, or on the sea or lakes or making the hole waterproof thanks to expensive casings.

DISCLOSURE OF THE INVENTION

An object of the present invention is to allow the carrying out of great diameter and high depth holes, for pilings or wells with an equipment limited in height, weight and cost, usable also under bridges, tunnels, buildings near electric cables, in lakes and in the sea.

Another object is to hardly increase the hole execution speed.

According to the method and the machine of the present invention, the drilled material is carried to the surface by a carrier canister or similar that slides along the drill stems rotated by a rotary, being linked to ropes moved by winches rotating integral with the stems. So the material can be quickly and continuously removed, without lifting and moving the stems and without necessarily stopping the drilling operations.

The above described objects are obtained in accordance with the content of the claims.

BRIEF DESCRIPTION OF THE DRAWINGS

The invention is now described, referring to the enclosed drawings that show as sample some possible embodiments, in which:

FIGS. 2 and 3 show respectively a side and a cross sectional view of a device for hooking the carrier canister the stems, in the releasing condition, with the free sliding of the carrier canister;

FIGS. 4 and 5 show the same particulars of FIGS. 2 and 3, in the hooking condition;

BEST MODE OF CARRYING OUT THE INVENTION

Figure 1:
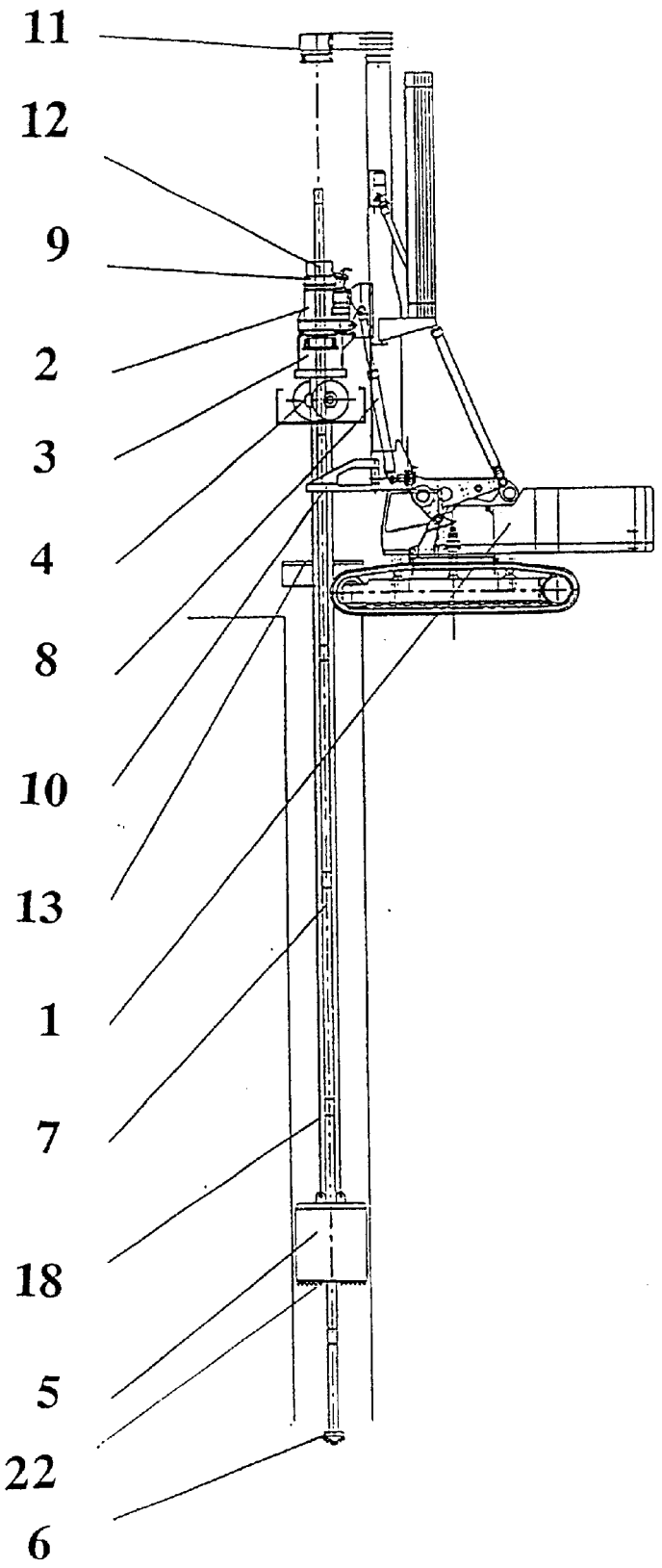
FIG. 1 shows a schematic side view of the operating drill, with the carrier canister during the lifting phase.

In FIG. 1, numeral 1 shows a basic machine that supplies hydraulic power to the rotary 2, and, by means of an hydraulic joint 3, to the winches 4, that rotate integral with the drill stems 7 having a plurality of longitudinal projecting guides 19. The numeral 5 show the carrier canister that is driven in the vertical movements by wire ropes 18 of the winches 4.

The numeral 6 indicates the drill tool, linked to the stem 7 inferior end. The penetration and extraction force is driven from the translation cylinders 8 of the rotary to the drill tool 6 by means of the stems 7 with a stem clamp 9.

The numeral 10 shows an auxiliary clamp that allows the stem holding during the extraction phase to facilitate the disassembling of this latter. The drill stems 7 are loaded by a loader 11 and connected by a device 12. The numeral 13 shows a conveyor for moving the removed material.

In FIGS. 2, 3, 4 and 5, the numeral 5' refers to an inner sleeve of the canister 5, provided with longitudinal grooves 21 of different width forming a shoulder 20.

The drilling material can be continuously carried to the surface, without stopping the drill and without lifting the stems, by means of the carrier canister 5 sliding on the drill stem 7, pulled by the wire ropes 18 linked to the winches 4 rotating integral with the stems.

To keep the carrier canister 5 down during the loading phase and to release it during the unloading phase, the automatic hooking device comprises the inner sleeve 5'. The inferior ends of the longitudinal projecting guides 19 can engage the shoulder 20 obtained by the longitudinal grooves 21.

At the end of the descendant run, the carrier canister 5 reaches the soil removed by the drill tool 6 during the ascendant, unload and descendant phases of the canister 5. To carry out the connection between the canister 5 and the stem inferior end, the stem clamp 9 clamps the stems 7 to the rotary 2 that is lifted by means of the translation cylinder 8, until the wire ropes 18 are loosed showing that the canister 5 is properly lifted by the drill tool 6. The rotary 2 rotates the drill stem 7 in the drilling rotation sense causing the overlay of the lower end of the longitudinal guides 19 on the shoulder 20 causing the automatic linkage between the stem 7 and the inner sleeve 5' of the canister 5. The above mentioned rotation in combination with a downward translation causes the opening of axial or radial valves, known and not illustrated, of the canister bottom that, consequently, can collect the removed soil.

In the hooking condition A of the canister 5 to the stem 7 by means of the inner sleeve 5', the canister 5 rotates integral with the stems 7. The canister 5 can be equipped with bottom drill tools such as drilling teeth 22 that, because of rotation, digs the soil together with the drill tool 6, consequently the diameter of the hole can be wider than the diameter of the drill tool 6 and equal to the diameter of the canister 5.

Figure 6:
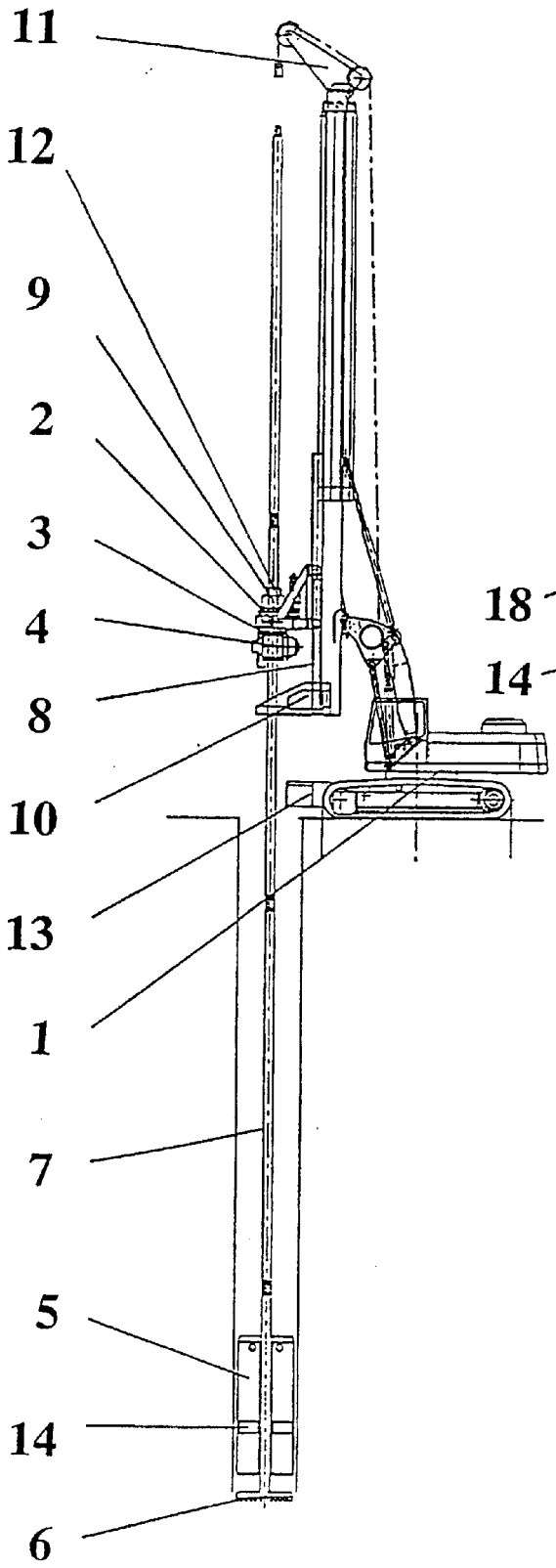
FIGS. 6 and 7 show two schematic side views of the drill equipped with a piston carrier canister, during two different working phases.
Figure 7:
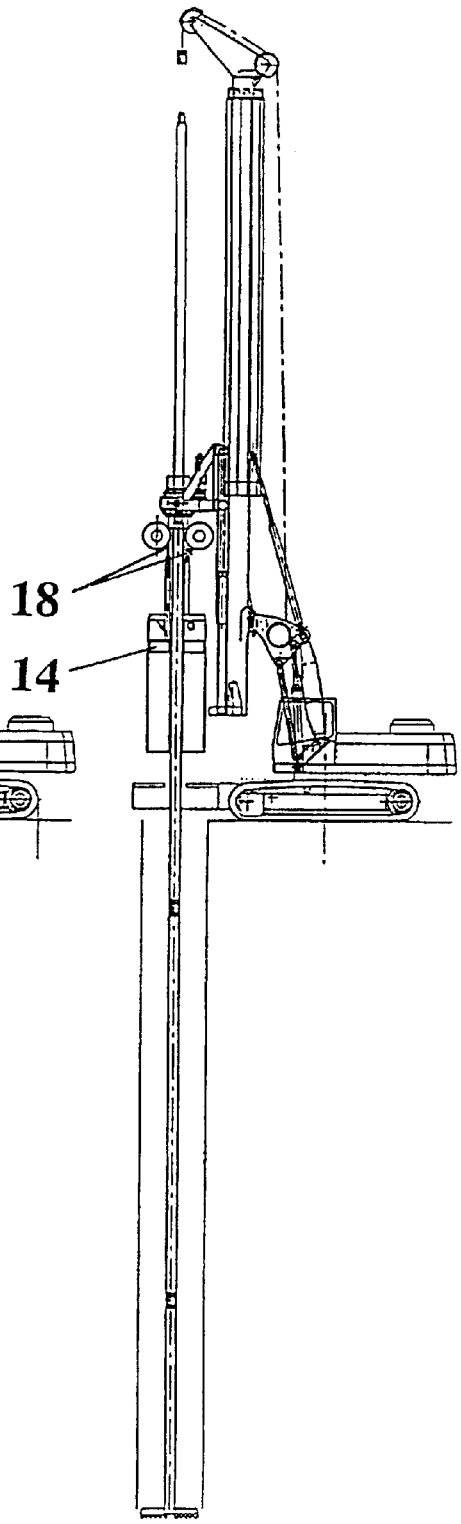

In the variant according to FIGS. 6 and 7, the carrier canister 5 has an inner piston 14 sliding inside the canister 5 and connected to the wire ropes 18 that facilitates the loading.

The piston 14, when is pulled by the wire ropes 18, intakes the removed soil inside the canister 5.

In this variant the drill tool 6 has the same diameter of the canister 5 that, consequently, is not equipped with bottom drill tools.

Figure 8:
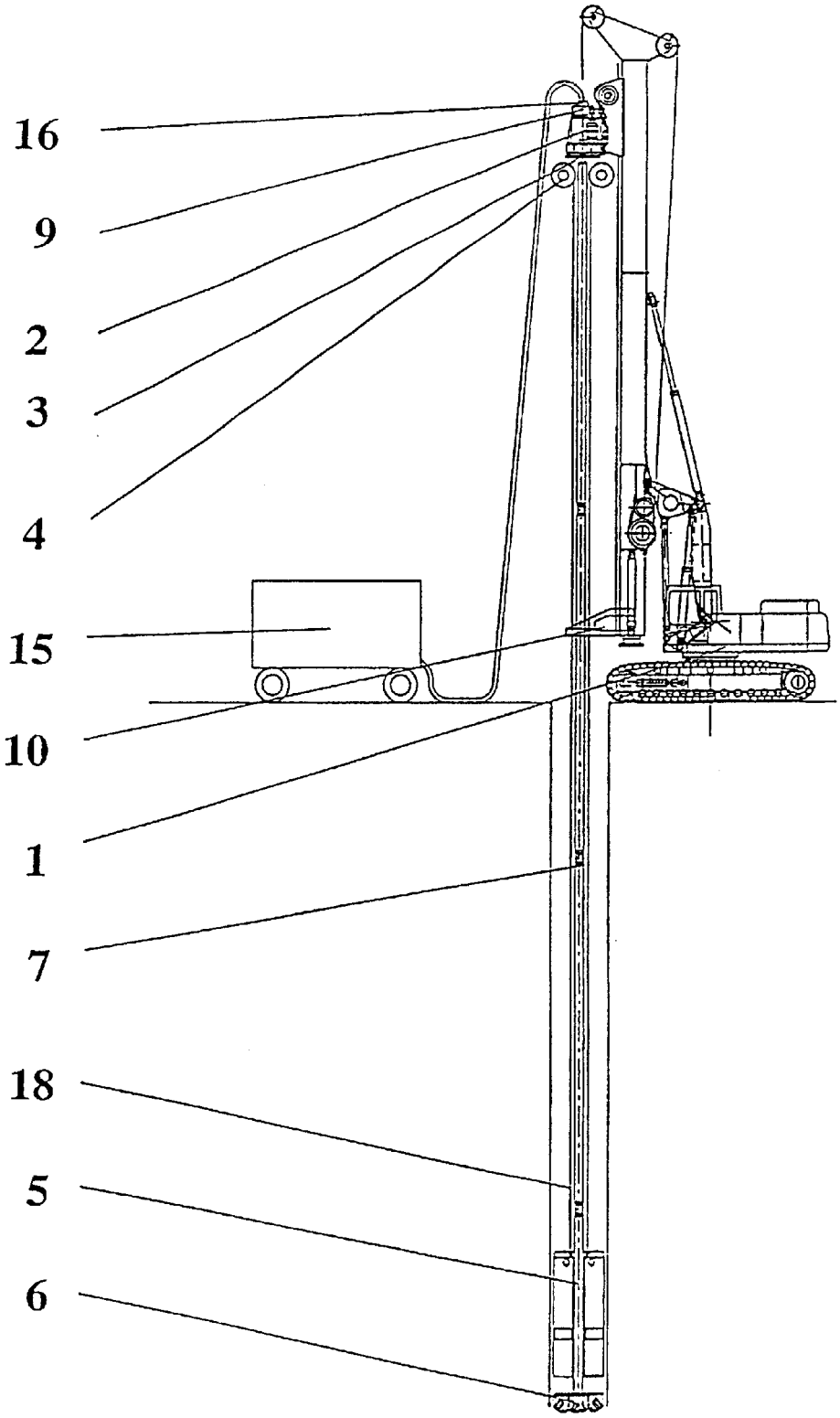
FIG. 8 shows a schematic side view of the working drill, equipped with a down hole-hammer and linked to a compressor.

In the variant of the drill according to FIG. 8 the numeral 16 indicates a joint connecting the stem bore to the outlet pipeline of an air compressor 15 and the drill tool 6 consists of a down hole-hammer or similar destruction tool.

In such case the compressed air coming from the compressor removes the material from the tool teeth or roller bit avoiding the obstruction of the drill tool 6. The flow supplied by the compressor is low because the material must be moved and not lifted to the surface.

Whatever variant used, the method and the drill of the present invention can quickly drill wide diameter and high depth holes and can also working near bridges, buildings, electric power line or other obstacles, in lakes and sea.

Figure 9:
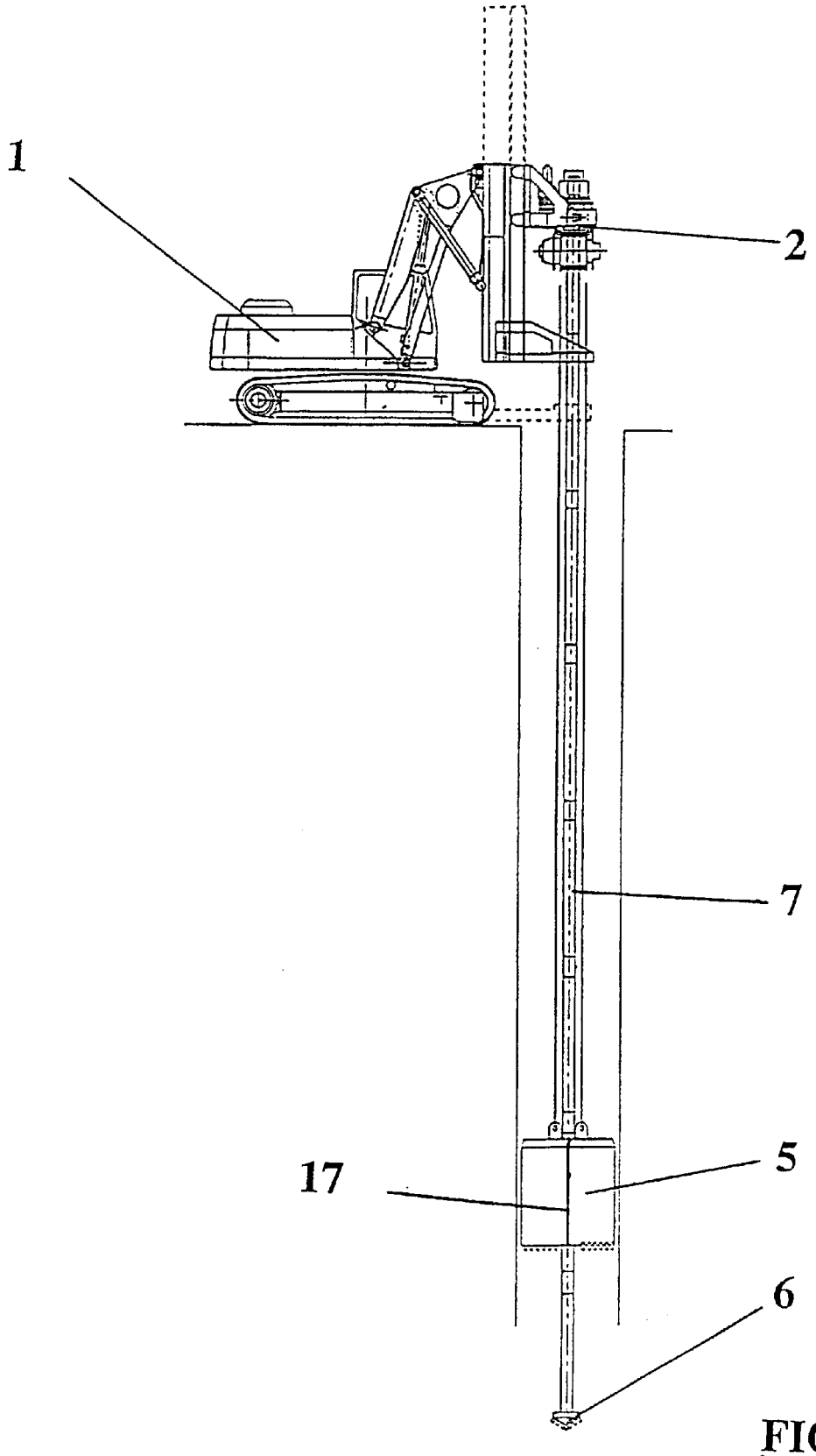
FIG. 9 shows a variant of the drill of FIG. 1 used for making high depth and wide diameter holes.

A variant of the carrier canister of the drill has a structure that can be opened, for example, along the opening line 17 of FIG. 9 so allowing the easy discharging of the carried material into the surface.

What is claimed is:

1. A drill for drilling wide diameter deep holes in soil comprising a base having a rotary equipped with a clamp, and having translation cylinders, the rotary rotates and the translation cylinders axially move a series of drill stems having a tool at a free end thereof, said drill having a hydraulic joint linked to the rotary, a carrier canister sidably connected to the drill stems, at least one winch linked to the hydraulic joint for rotation with the drill stems, the winch having at least one wire rope for slidably moving the carrier canister within the drill stems, the at least one wire rope, the tool and the winch being connected to the drill stems which have at least one longitudinally projecting guide having a lower free end located distally from the tool, the canister having an axial inner sleeve having at least one internal groove into which the at least one guide slides in correspondence to an axial movement of the canister within the stems, the at least one groove having a transversal shoulder as a stop for receiving a lower end of the at least one guide for hooking the canister to the series of stems, the canister having an inner piston linked to the at least one wire rope to ease the loading of material into the canister.

2. The drill according to claim 1 wherein the canister has drilling teeth on a bottom thereof.

3. The drill according to claim 1 wherein the canister has opening lines for opening the canister.

4. The drill according to claim 1 further comprising a conveyor placed near the base for transporting material removed by the canister.

5. The drill according to claim 1 further comprising an auxiliary clamp located under the winch for disassembling the stems.

6. The drill according to claim 1 further comprising a loader for feeding the stems to a stem connection device.

7. The drill according to claim 1 wherein the tool has a down hole hammer, a compressor supplying an air jet flow through a joint to the down hole hammer.

8. A method for drilling wide diameter deep holes in soil comprising:

providing a drill having a base having a rotary equipped with a clamp and having translation cylinders, the rotary rotating and the translation cylinders axially moving a series of drill stems having a tool at a free end thereof, said drill having a hydraulic joint linked to the rotary, a carrier canister connected to the drill stems and at least one winch linked to the hydraulic joint for rotating with the drill stems, the winch having at least one wire rope, the carrier canister slidably connected with the drill stems for displacement by the wire rope, between the rotary and the tool, the tool and winch being connected: to the stems which have at least one longitudinally projecting guide having a lower free end located distally from the tool, the canister having an axial inner sleeve having at least one internal groove into which the at least one longitudinally projecting guide slides in correspondence to an axial movement of the canister along the stems, at least one groove having a transversal shoulder as a stop for receiving the lower free end of guide when the canister is hooked to the series of stems;

slidably descending the canister along the stems until the canister reaches a bottom of the hole;

rotating the canister for pressing the canister on the hole bottom for transferring a material into the canister;

lifting the canister to the soil surface and unloading the canister; and, rotating the tool and stems during the descending, loading and unloading of the canister.

9. The method according to claim 8 further comprising rotating the tool and stems during the lifting of the canister.

10. The method according to claim 8 further comprising drilling the hole by rotating the canister.

11. The method according to claim 8 further comprising, after the descent of the canister to the hole bottom, deactivating the rotation of the stems, lifting the stems up for contacting the tool with a bottom of the canister, reactivating rotation of the stems upon hook up of the stems with the canister to continue drilling.

12. A method for drilling wide diameter deep holes in soil comprising:

providing a drill having a base having a rotary equipped with a clamp and having translation cylinders, the rotary rotating and the translation cylinders axially moving a series of drill stems having a tool at a free end thereof, said drill having a hydraulic joint linked to the rotary, a carrier canister connected to the drill stems and at least one winch linked to the hydraulic joint for rotating with the drill stems, the winch having at least one wire rope, the carrier canister slidably connected with the drill stems for displacement by the wire rope, between the rotary and the tool, the tool and winch being connected to the stems which have at least one longitudinally projecting guide having a lower free end located distally from the tool, the canister having an axial inner sleeve having at least one internal groove into which the at least one longitudinally projecting guide slides in correspondence to an axial movement of the canister along the stems, at least one groove having a transversal shoulder as a stop for receiving the lower free end of the guide when the canister is hooked to the series of stems;

slidably descending the canister along the stems until the canister reaches a bottom of the hole;

rotating the canister for pressing the canister on the hole bottom for transferring a material into the canister;

lifting the canister to the soil surface and unloading the canister; and, before the lifting of the canister, deactivating stem rotation and counter rotating the stems to cause an axial release of the canister from the stems.

* * * * *